US005166728A

United States Patent [19]

Nagaoka et al.

[11] Patent Number: 5,166,728

[45] Date of Patent: Nov. 24, 1992

[54] ELECTROPHOTOGRAPHIC PRINTER HAVING A THERMAL CONDUCTIVE MEMBER INTERPOSED BETWEEN CLEANING AND HEAT FUSING MEANS

[75] Inventors: Kazuhiko Nagaoka; Mitimasa Ootake, both of Tokyo, Japan

[73] Assignee: Oki Electric Industry Co., Ltd., Tokyo, Japan

[21] Appl. No.: 635,254

[22] Filed: Dec. 28, 1990

[30] Foreign Application Priority Data

Dec. 29, 1989 [JP] Japan ..... 1-151874

[51] Int. Cl.[5] ..... G03G 15/00

[52] U.S. Cl. ..... 355/200; 355/30

[58] Field of Search ..... 355/200, 282, 285, 289, 355/290, 296, 298, 30

[56] References Cited

U.S. PATENT DOCUMENTS 3,941,471 3/1976 Schatka et al. ..... 355/282

FOREIGN PATENT DOCUMENTS 0151979 9/1982 Japan ..... 355/282

*Primary Examiner*—A. T. Grimley
*Assistant Examiner*—Sandra L. Brasé
*Attorney, Agent, or Firm*—Spencer, Frank & Schneider

[57] ABSTRACT

In an electrophotographic printer, a thermal conductive member interposed between, a heat fusing means and a cleaning means for levelling the temperature distribution of the heat to be transmitted to the cleaning means in order to prevent the heat from being one-sided. The toner can be prevented from being melted.

13 Claims, 4 Drawing Sheets

ELECTROPHOTOGRAPHIC PRINTER HAVING A THERMAL CONDUCTIVE MEMBER INTERPOSED BETWEEN CLEANING AND HEAT FUSING MEANS

BACKGROUND OF THE INVENTION

The present invention relates to an electrophotographic printer provided with a cleaning device and capable of removing a toner residual on an outer circumference of a photoconductor after transferring the toner to a paper of the electrophotographic printer.

In a conventional electrophotographic printer, an image is formed on the circumference of the photoconductor by the use of a charging unit, an exposing unit, a developing unit and a transferring unit, and the resultant image on the photoconductor is transferred to the paper. The toner residual on the outer circumference of the photoconductor, after the image has been transferred to the paper, is removed by a cleaning device and the toner is supplied afresh to the photoconductor so that the photoconductor can form the image thereon and transfer the image to the paper. The toner is fixed to the paper, to which the image is transferred, by a heat fusing device so that the duplication to the paper is completed and the duplicated paper is thereafter discharged. The toner removed, by the cleaning device is collected and utilized for the next supply.

In order to keep up the quality of the image transferred to the paper, there has been developed recently an electrophotogaphic printer unit comprising a photoconductor, a developing unit and a cleaning device which have respectively their own specific life and are required to have a precise positional relation therebetween. These components can be fabricated as unit, thereby eliminating the adjustment of the positional relation therebetween and rendering each unit replaceable with another unit. The units are formed of synthetic resin, at low cost and with ease since they are expandable.

In the electrophotograhic printer, for the convenience of the duplicating process, the heat fusing device is disposed adjacent to the cleaning device. Since the heat fusing device fixed the image by a heater at a temperature of 130° to 190° C., not a little heat is transmitted to the cleaning device. There is collected toner in the cleaning device. Since the toner begins to melt at a temperature of at least 50°, the temperature over 50° does not heat the toner in the cleaning device because of the distance between the heat fusing device and the cleaning device. However, the following problems occur in the electrophotographic printer.

There are disposed a motor and a heat source such as a power supply adjacent to the cleaning device for rotatably driving the photoconductor due to a recent tendency to miniaturize the electrophotographic printer. Hence, the heat applied to the cleaning device is from the heat fusing device and from the heat source such as the motor or power supply. As a result, the heat is sharply increased to exceed a temperature of 50° C. at the portion where the heat source such as the motor or the power supply is disposed in the cleaning device, thereby melting the toner. The melted toner can not be utilized again. If the melted toner is cooled and solidified, the mechanism in the cleaning device is liable to stop, which causes trouble. It is possible to increase the distance between the heat source and the cleaning device but it is contrary to the trend toward miniaturization of the electrophotographic printer.

SUMMARY OF THE INVENTION

It is an object of the present invention to prevent the toner from melting due to the heat of the toner collected by the cleaning device in order to realize the miniaturization of the electrophotographic printer.

It is another object of the present, invention to prevent the toner from melting due to the heat collected by the cleaning device both easily and at low cost.

The electrophotographic printer according to the present invention comprises an image forming means for forming the image on an outer circumference thereof by the toner, a transfer means for transferring the resultant image to a paper, a cleaning means for collecting the toner residual on the outer circumference image forming means after the image is transferred by the transfer means to the paper, a heat fusing means for fixing the image transferred on the paper by the heat and a thermal conductive member disposed between the cleaning means and the heat fusing means.

With the arrangement set forth above, i.e. by employing the thermal conductive member, even if the temperature distribution of the heat to be transmitted to the cleaning device is biased or one-sided, the heat is absorbed by the thermal conductive member before the heat is transmitted to the cleaning device so that the heat is transmitted from the portion having a high temperature to the portion having a low temperature, whereby the levelled heat is transmitted to the cleaning device. As a result, it is possible to prevent the toner from melting and realize the miniaturization of the electrophotographic printer.

DESCRIPTION OF THE PREFERRED EMBODIMENT

Figure 1:
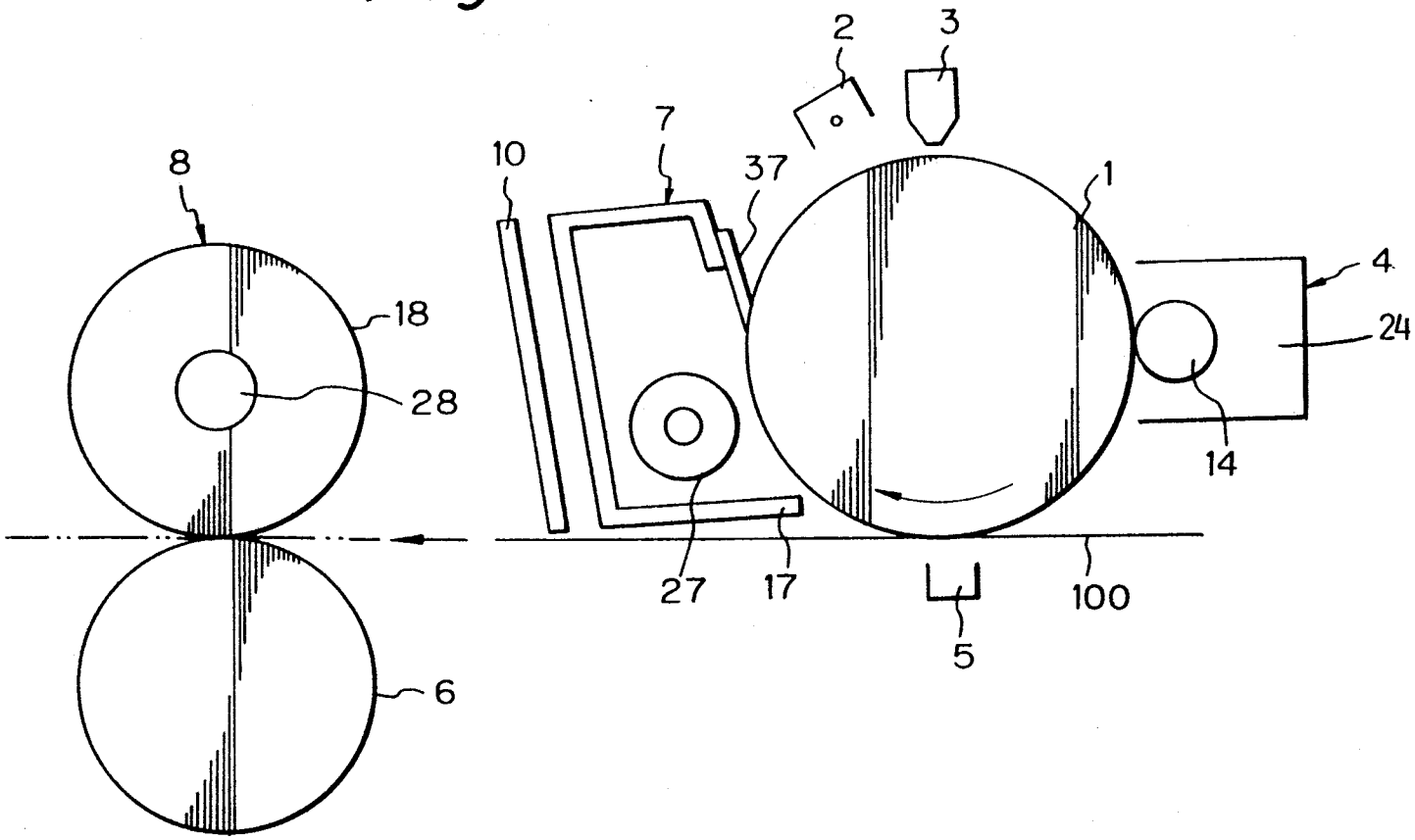
FIG. 1 is a side elevational view showing an arrangement of an electrophotographic printer according to a first embodiment of the present invention.
Figure 2:
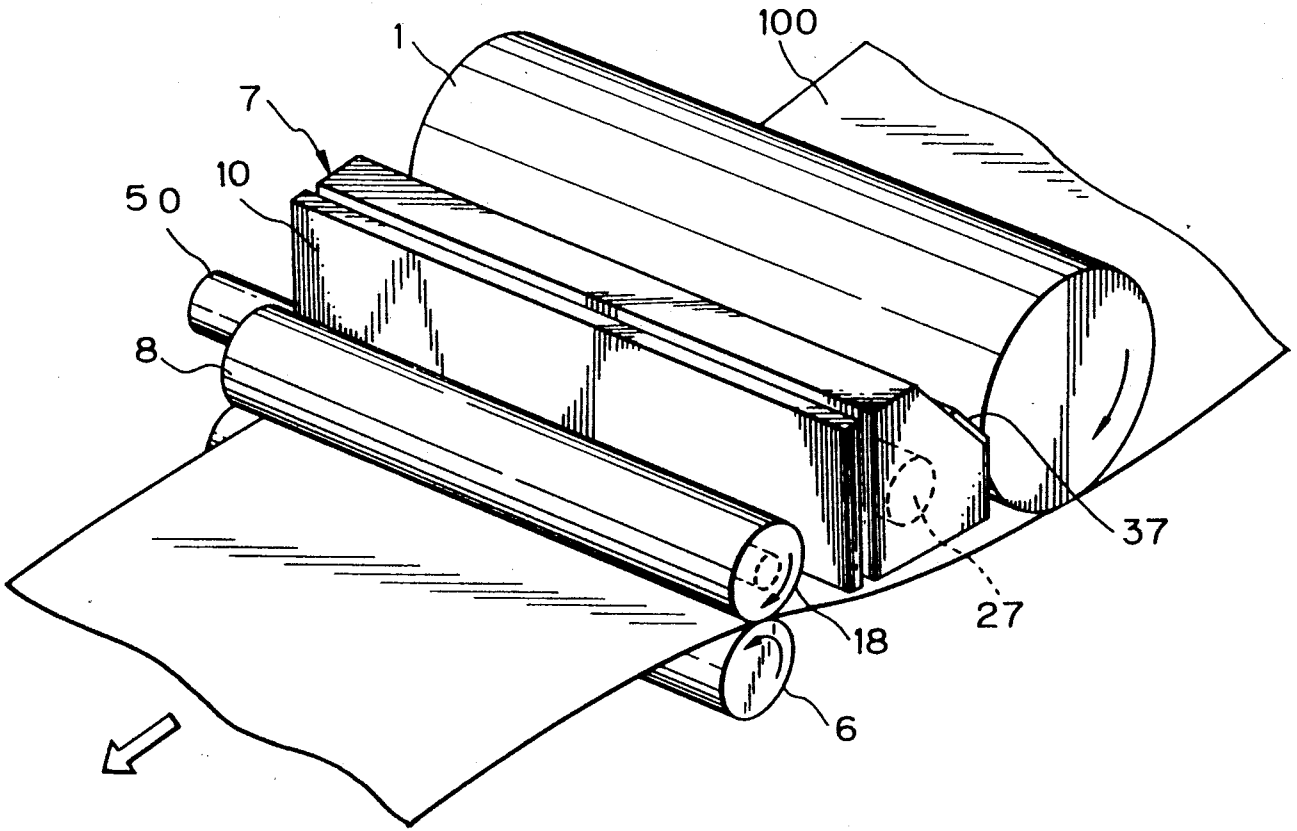
FIG. 2 is a perspective view of FIG. 1.

First Embodiment (FIGS. 1 and 2)

An electrophotographic printer according to a first embodiment will be described with reference to FIGS. 1 and 2.

The electrophotographic printer is cylindrical and comprises a rotatable photoconductor 1, a charging unit 2 for first uniformly charging a circumferential surface of the photoconductor 1, an exposing unit 3 for writing a content to be duplicated in the charged photoconductor 1 and exposing the content, a developing unit 4 provided with a developing roller 14 for forming an image relative to the exposed content by a toner supplied from a toner reservoir 24, a transferring unit 5 for transferring the image formed by the toner on the circumferential surface of the photoconductor 1 to a paper, a cleaning device 7 for collecting the toner residual on the circumferential surface of the photoconductor 1 after the image formed by the toner is transferred to the paper, and a heat fusing unit 8 provided with a heater 28 and a pair of delivery rollers 18 and 6 for fixing the toner to the paper 100 to which the image was transferred by the heat from the heater 28 and duplicating the image on the paper delivered by the pair of delivery rollers 18 and 6. That is, the image is duplicated to the paper by the successive operations of charging, exposing, developing, transferring and fixing while, the photoconductor is rotated.

In the description of there is omitted the explanation of the charging unit 2, the exposing unit 3, the developing unit 4, and the transferring unit 5 which are not the gist of the present invention, but the cleaning device is described hereinafter.

The cleaning device 7 comprises a blade 37 for scraping the toner residual on the photoconductor 1 accompanied by the rotation of the photoconductor 1, a collecting tank 17 for collecting the toner thus scraped by the blade, 37 and a rotating discharge roller 27 which discharges the toner from the collecting tank 17 in order to deliver the collected toner to the toner reservoir 24 for utilizing the toner again. The collecting tank 17, the discharge roller 27 and the blade 37 are respectively substantially the same length as the photoconductor 1.

In FIG. 2, there is illustrated a motor 50 adjacent to the cleaning device 7 for rotating the photoconductor 1 and the discharge roller 27. There is provided a thermal conductive member 10 between the heat fusing unit 8 and the cleaning device ,7 for, preventing changes in the toner such as melting due to the heat from the motor 50 and the heat fusing unit 8. The thermal conductive member 10 is formed of a metal plate having a high coefficient of thermal conductivity such as an aluminum or copper plate. The thermal conductive member 10 absorbs the heat from the motor 50 and the heat fusing unit 8 and transmits the thus absorbed heat from the portion having a high temperature to the portion having a low temperature. Hence, even if the temperature distribution is biased or one-sided, the heat to be transmitted to the cleaning device is made uniform or levelled, thereby preventing the toner from reaching a temperature at which it undergoes a change such as being melted.

The experiment was made by use of an aluminium plate having a thickness of 2 mm as the thermal conductive member and revealed that the temperature at the portion adjacent to the motor in the cleaning device 7 is increased about 10° C. and does not reach 50° even if the same temperature is added to the operation guaranteed temperature (about 30° C.) of the electrophotographic printer so that the toner is not likely to be melted. If an aluminium plate is employed as the thermal conductive member 10, the effect of the present invention can be obtained if it has a thickness of at least 0.5 mm.

Accordingly, it is possible to suppress the heat to be transmitted to the cleaning device 7 and deliver the heat without rendering the temperature distribution to be one-sided so that the toner is prevented from melting and from solidifying, thereby eliminating problems such as the toner being hardly discharged from the discharge roller 27 or the discharge roller being hardly rotated.

Figure 3:
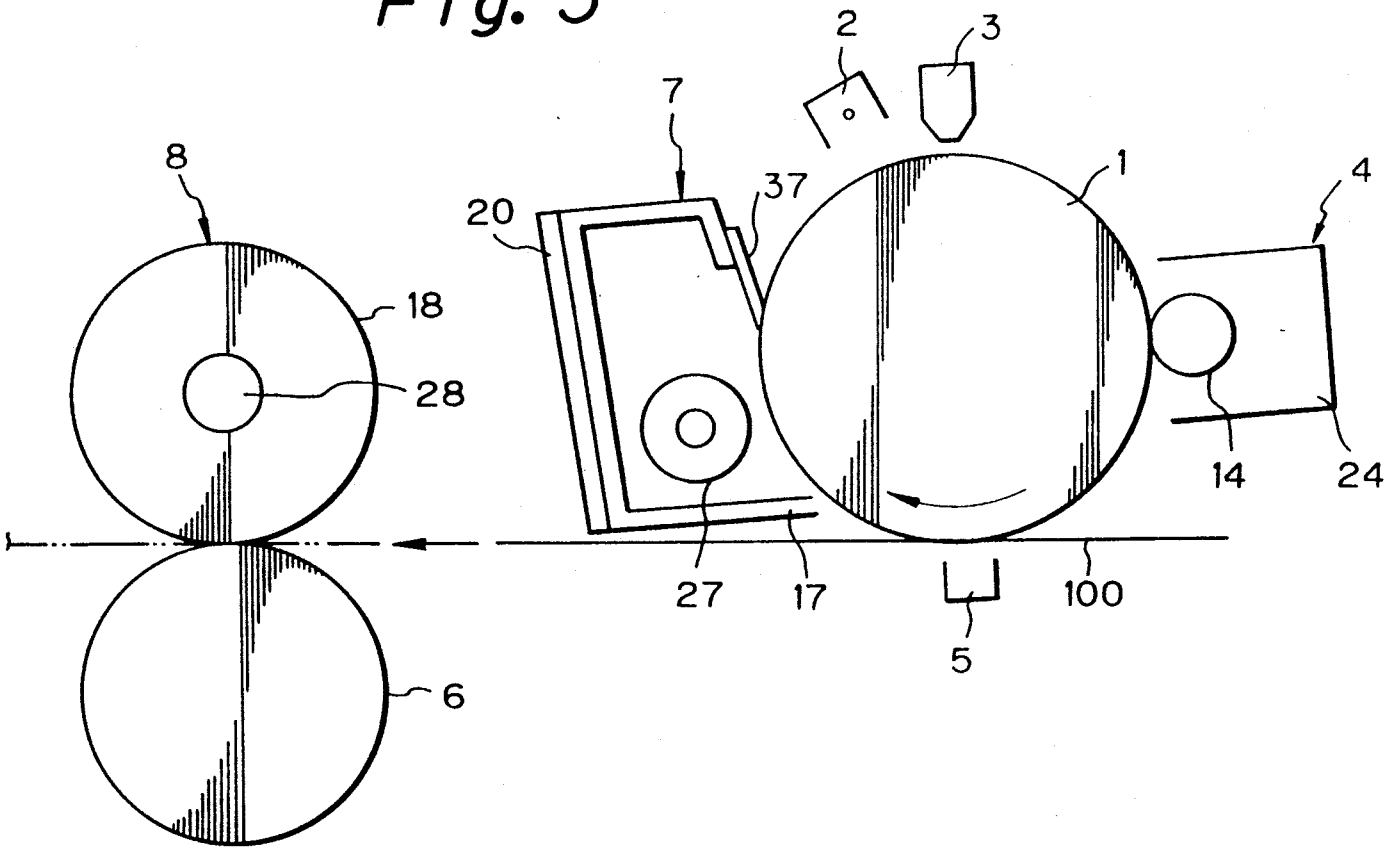
FIG. 3 is a side elevational view showing an arrangement of an electrophotographic printer according to a second embodiment of the present invention.

Second Embodiment (FIG. 3)

An electrophotographic printer according to a second embodiment will be described with reference to FIG. 3.

A thermal conductive member 20 according to the second embodiment is attached to the collecting tank 17 of the cleaning device 7 at the portion confronting the heat fusing unit 8. With such an arrangement, the distance from the heat fusing unit 8 or the motor to the thermal conductive member 20 is increased, i.e. the distance to receive the heat is expanded, compared with the first embodiment, the thermal conductive member 20 can absorb and level the heat at low temperature. Furthermore, the thermal conductive member 20 can absorb the heat to be transmitted to the cleaning device 7 at all times and level the temperature in the collecting tank 17 at all times. Although it is possible in the embodiment of FIGS. 1 and 2 for the heat which is not, absorbed by the thermal conductive member 10 to be transmitted around from the upper and lower portions of the conductive member 10 to the cleaning device 7, this cannot occur in the embodiment of FIG. 3 because the thermal conductive member 20 is attached to the cleaning device 7. The collected toner accumulates at the lower portion in the collecting tank 17 and the lower surface of the collecting tank 17 forms the delivery route of the paper so that, the ventilation is effective and no problem is created even if the heat is delivered at the upper surface or the lower surface of the collecting tank 17.

Figure 4:
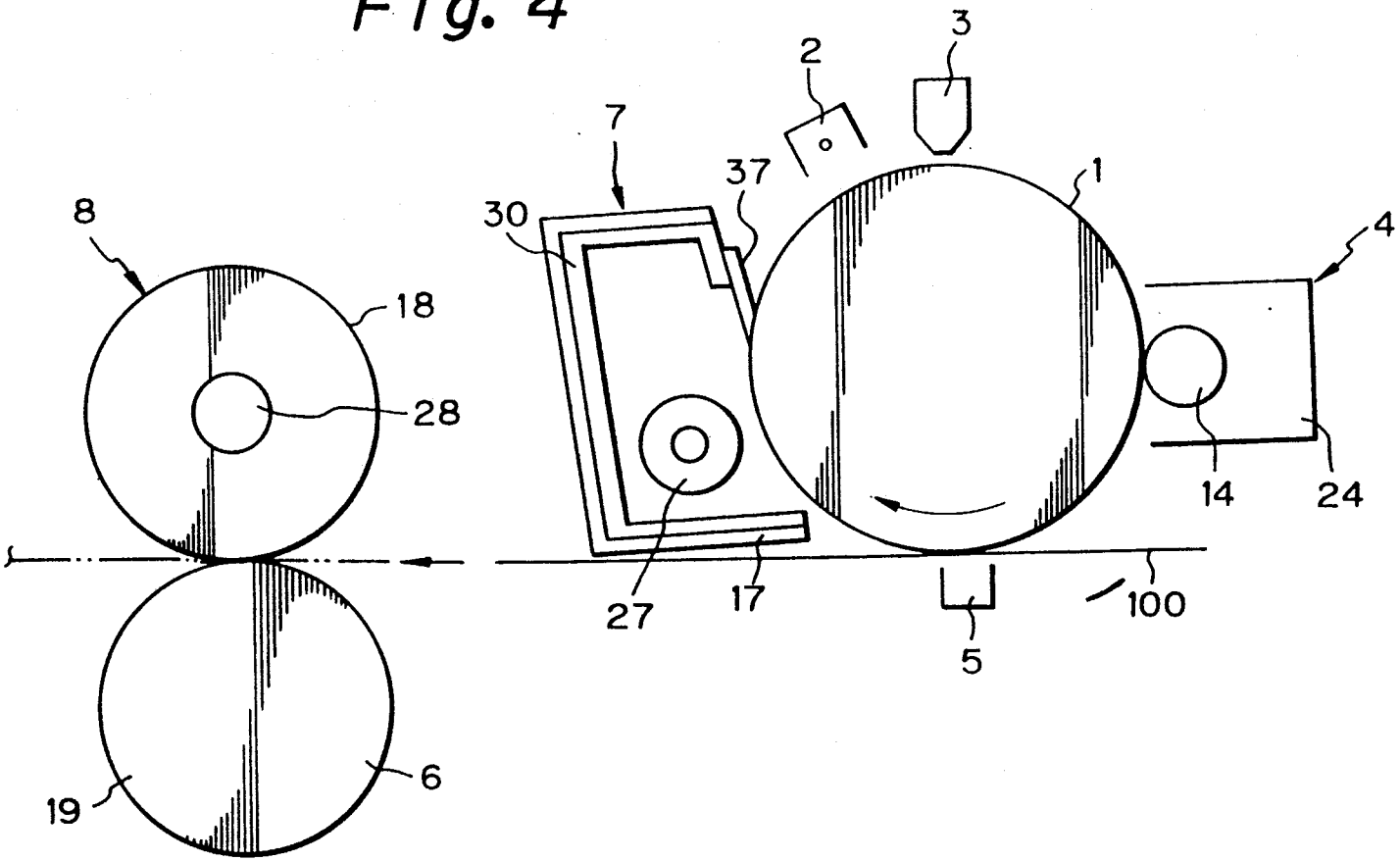
FIG. 4 is a side elevational view showing an arrangement of an electrophotographic printer according to a third embodiment of the present invention.

Third Embodiment (FIG. 4)

An electrophotographic printer according to a third embodiment will be described with reference to FIG. 4.

A thermal conductive member 30 according to the third embodiment is attached to collecting tank 17 at the backside of the portion confronting the heat fusing unit 8 so as to cover the entire backside thereof, i.e. attached to an entire inner wall of the cleaning device 7. The thermal conductive member 30 has the upper end bent toward the photoconductor 1 to serve as the upper plate of the collecting tank 17 and the tip end of the upper end bent downward to support the blade 37. According to the third embodiment, inasmuch as the thermal conductive member 30 covers the collecting tank 17 widely, the temperature distribution in the collecting tank 17 more effectively leveled.

Provided that the thermal conductive material has the surface provided with a mirror to improve the heat reflectance and level the absorbed heat alone, more effective thermal conductivity can be obtained.

What is claimed is:

1. An electrophotographic printer comprising:

an image forming means for forming an image by a toner on an outer circumferential surface thereof;

a transferring means for transmitting the image formed by the toner on the circumferential surface of the image forming means to a paper;

a cleaning means for collecting the residual toner on the outer circumferential surface of the image forming means after the image formed by the toner is transferred to the paper by the transfer means;

a heat fusing means for fixing the toner to the paper to which the image was transferred by the heat; and a thermal conductive member disposed between the cleaning means and the heat fusing means.

2. An electrophotographic printer according to claim 1, wherein the thermal conductive member has a flat shape.

3. An electrophotographic printer according to claim 2, wherein the thermal conductive member has a surface provided with a mirror.

4. An electrophotographic printer according to claim 1, wherein the size of the thermal conductive member is substantially the same as the surface of the cleaning means confronting the thermal fusing means.

5. An electrophotographic printer according to claim 4, wherein the size of the thermal conductive member is substantially the same as the surface of the cleaning means confronting the thermal fusing means.

6. An electrophotographic printer according to claim 1, wherein the thermal conductive member has a surface provided with a mirror.

7. An electrophotographic printer comprising:

an image forming means for forming an image by a toner on an outer circumferential surface thereof;

a transferring means for transferring the image formed by the toner on the circumferential surface of the image forming means to a paper;

a cleaning means for collecting the residual toner on the outer circumferential surface of the image forming means after the image formed by the toner is transferred to the paper by the transfer means;

a heat fusing means for fixing the toner to the paper to which the image was transferred by the heat; and a thermal conductive member attached to the surface of the cleaning means confronting the heat fusing means.

8. An electrophotographic printer according to claim 7, wherein the thermal conductive member has a flat shape.

9. An electrophotographic printer according to claim 8 wherein the size of the thermal conductive member is substantially the same as the surface of the cleaning means confronting the thermal fusing means.

10. An electrophotographic printer according to claim 8, wherein the thermal conductive member has a surface provided with a mirror.

11. An electrophotographic printer according to claim 9, wherein the size of the thermal conductive member is substantially the same as the surface of the cleaning means confronting the thermal fusing means.

12. An electrophotograhic printer according to claim 7, wherein the thermal conductive member has a surface provided with a mirror.

13. An electrophotographic printer comprising:

an image forming means for forming an image by a toner on an outer circumferential surface thereof;

a transferring means for transferring the image formed by the toner on the circumferential surface of the image forming means to a paper;

a cleaning means for collecting the residual toner on the outer circumferential surface of the image forming means after the image formed by the toner is transferred to the paper by the transfer means;

a heat fusing means for fixing the toner to the paper to which the image was transferred by the heat; and a thermal conductive member attached to an entire inner wall of the cleaning means.

* * * * *